US012650123B2

(12) United States Patent
Kawabe et al.

(10) Patent No.: US 12,650,123 B2
(45) Date of Patent: Jun. 9, 2026

(54) LIQUID FEEDING PUMP AND LIQUID FEEDING METHOD

(71) Applicant: HITACHI HIGH-TECH CORPORATION, Tokyo (JP)

(72) Inventors: Shunsuke Kawabe, Tokyo (JP); Nobuhiro Tsukada, Tokyo (JP); Masuyuki Sugiyama, Tokyo (JP); Yushi Harada, Tokyo (JP); Daisuke Kanai, Tokyo (JP)

(73) Assignee: HITACHI HIGH-TECH CORPORATION, Tokyo (JP)

( * ) Notice: Subject to any disclaimer, the term of this patent is extended or adjusted under 35 U.S.C. 154(b) by 0 days.

(21) Appl. No.: 18/847,863

(22) PCT Filed: Feb. 28, 2023

(86) PCT No.: PCT/JP2023/007223
§ 371 (c)(1),
(2) Date: Sep. 17, 2024

(87) PCT Pub. No.: WO2023/203881
PCT Pub. Date: Oct. 26, 2023

(65) Prior Publication Data

US 2025/0198403 A1 Jun. 19, 2025

(30) Foreign Application Priority Data

Apr. 19, 2022 (JP) ..... 2022-068588

(51) Int. Cl.
*F04B 49/08* (2006.01)
*F04B 23/06* (2006.01)
*F04B 49/06* (2006.01)

(52) U.S. Cl.
CPC ..... *F04B 49/08* (2013.01); *F04B 23/06* (2013.01); *F04B 49/065* (2013.01); *F04B 2205/05* (2013.01)

(58) Field of Classification Search
CPC ..... F04B 23/06; F04B 49/065; F04B 49/08; F04B 2205/05; G01N 2030/326
See application file for complete search history.

(56) References Cited

U.S. PATENT DOCUMENTS 4,797,207 A * 1/1989 Honganen ..... G01N 30/34 417/18
5,108,264 A * 4/1992 Abdel-Rahman ... F04B 11/0075 417/20

(Continued)

FOREIGN PATENT DOCUMENTS

JP H07-280787 A 10/1995
JP 2007113439 A * 5/2007 ..... G01N 30/32

(Continued)

OTHER PUBLICATIONS

International Search Report, mailed May 9, 2023, for International Application No. PCT/JP2023/007223.

*Primary Examiner* — Alexander B Comley
(74) *Attorney, Agent, or Firm* — Baker Botts L.L.P.

(57) ABSTRACT

Provided is a controller of a liquid feeding pump configured to: calculate a first amount of compression of a solvent by a first plunger in one driving cycle based on a compression rate parameter and control the first plunger to compress the solvent by the first compression amount in the driving cycle; when a value relating to a pressure value measured by the pressure sensor is below a threshold in the driving cycle, change the compression rate parameter according to the pressure value, and calculate a second amount of compression of the solvent by the first plunger in a subsequent driving cycle, based on the changed compression rate (Continued)

parameter; and when the value relating to the pressure value exceeds the threshold in the driving cycle, calculate a third amount of compression of the solvent by the first plunger in the subsequent driving cycle, based on the original compression rate parameter.

8 Claims, 7 Drawing Sheets

(56) References Cited

U.S. PATENT DOCUMENTS

| | | | | |
|---|---|---|---|---|
| 8,191,405 | B2 * | 6/2012 | Yasuhara | G01N 30/32 73/61.56 |
| 9,360,006 | B2 * | 6/2016 | Herzog | F04B 49/08 |
| 9,410,543 | B2 * | 8/2016 | Tokuo | F04B 17/03 |
| 11,098,702 | B2 * | 8/2021 | Yanagibayashi | F04B 11/0075 |
| 2007/0000312 | A1 * | 1/2007 | Weissgerber | G05D 11/132 700/282 |
| 2012/0055581 | A1 * | 3/2012 | Akieda | G01N 30/32 141/36 |
| 2013/0104631 | A1 * | 5/2013 | Tokuo | F04B 23/06 73/61.56 |
| 2014/0318224 | A1 * | 10/2014 | Onoda | G01N 30/32 137/565.15 |
| 2020/0278329 | A1 * | 9/2020 | Yanagibayashi | F04B 11/0058 |

FOREIGN PATENT DOCUMENTS

| | | | | |
|---|---|---|---|---|
| JP | 2008264640 | A * | 11/2008 | |
| JP | 2008291848 | A * | 12/2008 | |
| JP | 2009013957 | A * | 1/2009 | |
| JP | 2009180617 | A * | 8/2009 | F04B 11/0075 |
| JP | 5624825 | B2 * | 11/2014 | F04B 49/06 |
| JP | 6849095 | B2 * | 3/2021 | F04B 23/06 |
| WO | WO-2019021475 | A1 * | 1/2019 | F04B 13/00 |
| WO | WO-2019082243 | A1 * | 5/2019 | G01N 30/32 |
| WO | WO-2021149325 | A1 * | 7/2021 | G01N 30/32 |

* cited by examiner

LIQUID FEEDING PUMP AND LIQUID FEEDING METHOD

TECHNICAL FIELD

The present disclosure relates to a liquid feeding pump and a liquid feeding method.

BACKGROUND ART

In general, a liquid chromatograph includes a liquid feeding pump, an injector introducing a sample into the liquid chromatograph, a separation column, a detector, a waste liquid container, and a system control section that controls these components. Further, the liquid feeding pump for use in the liquid chromatograph is generally configured such that two plunger pumps are connected in series. The plunger pump (first plunger pump) on an upstream side sucks, compresses, and discharges a solvent. Since the first plunger pump alone cannot perform liquid feeding at a constant flow rate, an additional plunger pump (second plunger pump) is connected on a downstream side. The second plunger pump counteracts a pulsating flow in the first plunger pump (discharges a solvent when the first plunger pump sucks and compresses the solvent), so that the liquid feeding pump, as a whole, can perform liquid feeding at a constant flow rate.

Compression of a solvent by the operation of the first plunger pump is a process of increasing the pressure of the sucked solvent from the atmospheric pressure to the pressure (discharge pressure) at which the second plunger pump discharges the solvent. Here, when the pressure of the solvent reaches the same as the discharge pressure, the compressing operation needs to end. If the compressing operation is continued exceeding the discharge pressure (excessive compression), in such a section, the first plunger pump and the second plunger pump both discharge the solvent, so that the flow rate of the liquid feeding pump increases, thereby increasing the discharge pressure. Meanwhile, if the compressing operation ends without reaching the discharge pressure due to insufficient compression (insufficient compression), in the subsequent process, a moment appears at which the first plunger pump and the second plunger pump neither discharges the solvent failing to perform liquid feeding, so that the discharge pressure reduces during that moment. If the flow rate fluctuates, the analysis accuracy as a liquid chromatograph deteriorates and in addition, the associated pressure pulsation exerts a load onto the separation column, resulting in hastening the wear. The pressure pulsation in the liquid feeding pump as a whole is preferably reduced by performing an optimum compression process.

An amount of compression of a solvent by the aforementioned first plunger pump is determined based on the discharge pressure, the compression rate of the solvent, and the capacity of the first plunger pump. Here, the discharge pressure is measured at any time by a pressure gauge present downstream of the second plunger pump, and the capacity of the first plunger pump is fixed at a design value. Meanwhile, since the compression rate of the solvent subtly changes depending on the type of the solvent or the temperature, it is difficult to use a pre-fixed value. Thus, in the liquid feeding pump, it is common practice to perform feedback correction of the compression rate parameter value for each operation cycle. For example, the liquid feeding pump repeats three phases of a single liquid feeding section, a compression section, and a cross liquid feeding section as one cycle. In the single liquid feeding section, the downstream second plunger pump performs liquid feeding and the upstream first plunger pump performs sucking. In the compression section, a control section calculates an amount of compression based on a current discharge pressure and a compression rate parameter and performs a compression process of the first plunger pump. At this point in time, if excessive compression occurs, thereby significantly increasing the discharge pressure, a feedback control of reducing the compression rate parameter is performed in the subsequent cycle. After the compression section ends, as the cross liquid feeding section, the first plunger pump performs liquid feeding and the second plunger pump performs sucking. At this time, if the pressure reduces due to insufficient compression, a feedback control of increasing the compression rate parameter is performed in the subsequent cycle. By performing such feedback controls for each cycle, excessive compression and insufficient compression are reduced.

As a technique of reducing excessive compression or insufficient compression, Patent Literature 1 discloses a liquid feeding pump provided with a pressure sensor that measures the pressure of a solvent inside the first plunger pump and a pressure sensor that measures the pressure of the solvent discharged by the second plunger pump. This liquid feeding pump controls the operation of the first plunger pump by comparing the values measured by the pressure sensors in the compression process. Patent Literature 2 discloses a liquid feeding pump in which the first plunger pump and the second plunger pump are connected in series and a pressure sensor is only provided downstream of the second plunger pump. Patent Literature 3 discloses a liquid feeding pump in which the flow rate is corrected and controlled based on the history of the compression volume in the compression process and the pressure (compression pressure) upon completion of the compression.

CITATION LIST

Patent Literature

Patent Literature 1: JP 5624825 B
Patent Literature 2: JP 2008-291848 A
Patent Literature 3: WO 2019/082243 A1
Patent Literature 4: JP H7-280787 A

SUMMARY OF INVENTION

Technical Problem

In general, in a liquid feeding pump, an injector for introducing a sample, a valve for switching a flow passage, and the like are provided together. When these components operate, the pressure fluctuates. For example, when an injection valve is switched and a liquid sample with the atmospheric pressure enters the flow passage with a high pressure, the pressure significantly reduces (injection shock) in a short period of time. When such a pressure fluctuation caused by an external effect of the liquid feeding pump accidently coincides with a compression section or a cross liquid feeding section of the liquid feeding pump, the liquid feeding pump recognizes the pressure fluctuation caused by disturbance as excessive compression or insufficient compression and performs an incorrect feedback control. In such an incorrect feedback control, the amount of compression is miscalculated, resulting in an increase in the pressure pulsation. Therefore, the pressure fluctuation resulted from disturbance such as the injection shock, valve switching, and the like is preferably excluded from the target of the feedback control in the pump liquid feeding. Patent Literature 4 discloses a control in which a control signal of a valve is acquired and the pressure fluctuation that occurs simultaneously with the valve switching is excluded. However, system designing of control signals of multiple valves to be processed as exceptional is complicated, which could increase the development cost. Therefore, the liquid feeding pump is preferably capable of determining disturbance without acquiring a control signal from an external device.

Thus, the present disclosure provides a liquid feeding pump capable of determining disturbance without acquiring a control signal from an external device and appropriately performing a feedback control of a compression rate parameter.

Solution to Problem

A liquid feeding pump of the present disclosure includes: a first plunger pump including a first plunger; a second plunger pump connected to the first plunger pump in series, the second plunger pump including a second plunger; a pressure sensor disposed downstream of the second plunger pump; a control section that controls driving of the first plunger and driving of the second plunger; and a memory section that stores a compression rate parameter for calculating an amount of compression of a solvent by the first plunger, in which the control section is configured to: calculate a first amount of compression of the solvent by the first plunger in one driving cycle based on the compression rate parameter and control the first plunger to compress the solvent by the first amount of compression in the one driving cycle; when a value relating to a pressure value measured by the pressure sensor is smaller than a threshold in the one driving cycle, change the compression rate parameter in accordance with the value relating to the pressure value, and calculate a second amount of compression of the solvent by the first plunger in a subsequent driving cycle, which is subsequent to the one driving cycle, based on the compression rate parameter after being changed; and when the value relating to the pressure value is greater than the threshold in the one driving cycle, calculate a third amount of compression of the solvent by the first plunger in the subsequent driving cycle, based on the compression rate parameter.

Advantageous Effects of Invention

According to the present disclosure, it is possible to determine disturbance without acquiring a control signal from an external device and to appropriately perform a feedback control of a compression rate parameter.

DESCRIPTION OF EMBODIMENTS

Embodiments of the present invention will be described in detail based on the drawings. In the following embodiments, it goes without saying that the constituent elements (including elemental steps, etc.) are not necessarily essential, unless otherwise, particularly explicitly stated as essential or considered apparently essential in principle.

Example 1

<Exemplary Configuration of Liquid Feeding Pump and Liquid Chromatograph>

Figure 1A:
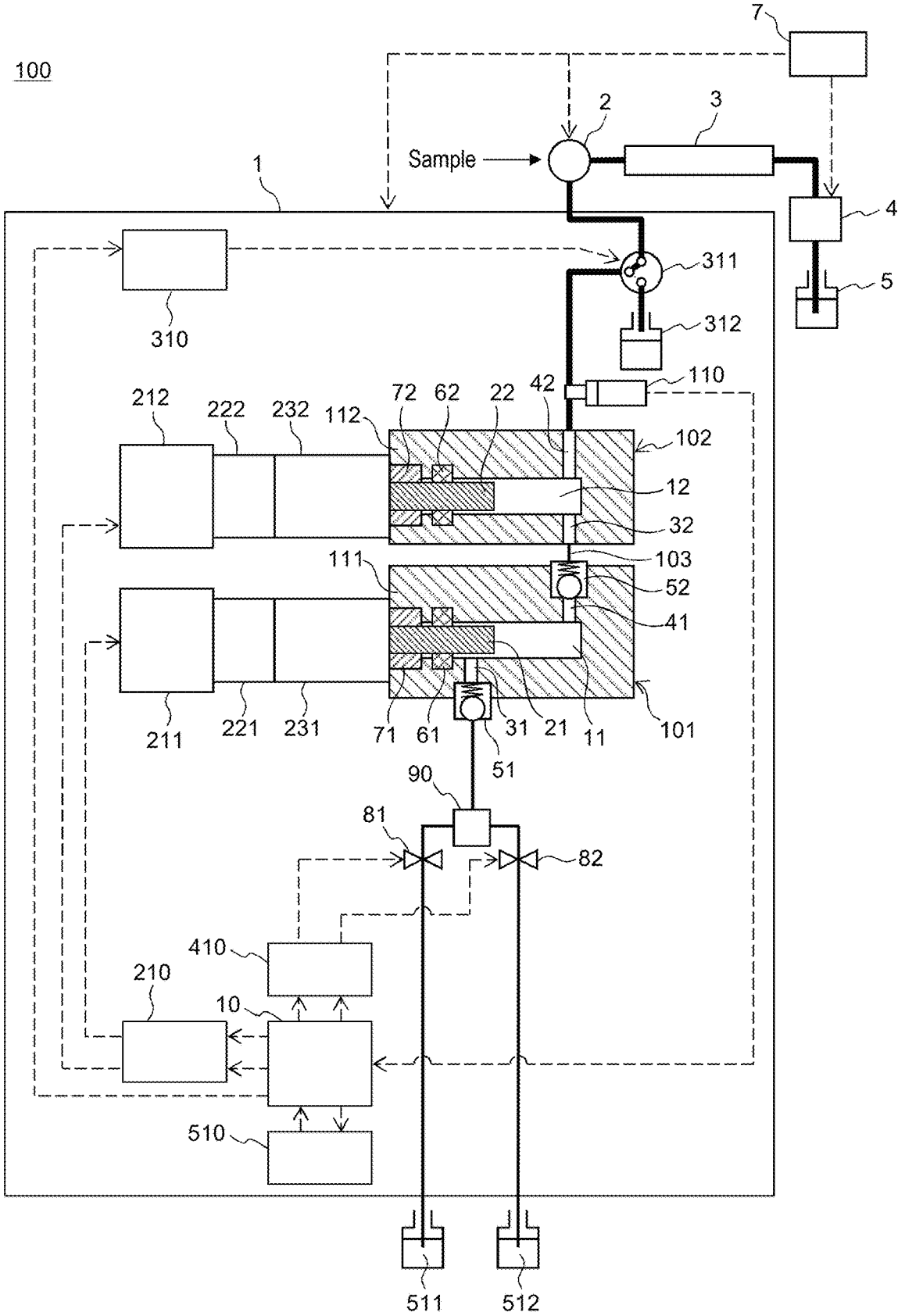
FIG. 1A is a schematic view illustrating the configuration of a liquid chromatograph including a liquid feeding pump of Example 1.

FIG. 1A is a schematic view illustrating the configuration of a liquid chromatograph including a liquid feeding pump of Example 1. As illustrated in FIG. 1A, a liquid chromatograph 100 includes a liquid feeding pump 1, an injector 2 introducing a sample into the liquid chromatograph 100, a separation column 3, a detector 4, a waste liquid container 5, and a system control section 7 that controls these components. For the injector 2, the separation column 3, the detector 4, and the waste liquid container 5, those generally used in the liquid chromatograph 100 can be used, and thus, their detailed configurations are not particularly described.

The liquid feeding pump 1 includes a controller 10 (a pump control section), a pressure sensor 110, a first plunger pump 101, a second plunger pump 102, a coupling flow passage 103, a first electromagnetic valve 81, a second electromagnetic valve 82, a motor driver 210, a purge valve driver 310, a purge valve 311, a waste liquid tank 312, an electromagnetic valve driver 410, and a memory section 510. The first plunger pump 101 and the second plunger pump 102 are connected in series. The first plunger pump 101 is disposed on an upstream side and the second plunger pump 102 is disposed on a downstream side.

The pressure sensor 110 is installed downstream of the second plunger pump 102. The pressure sensor 110 measures a pressure (discharge pressure) of a solvent (liquid) discharged from the second plunger pump 102 and outputs a pressure value to the controller 10.

The controller 10 provides command values to the motor driver 210 and the electromagnetic valve driver 410 respectively based on the discharge pressure measured by the pressure sensor 110 and a predetermined operation sequence so as to operate the motor driver 210 and the electromagnetic valve driver 410. Further, the controller 10 provides a command value to the purge valve driver 310 based on the predetermined operation sequence so as to operate the purge valve driver 310.

The first plunger pump 101 includes a first pump head 111 in which a first pressurization chamber 11, a first plunger 21, a first suction passage 31, a first discharge passage 41, a first check valve 51, a second check valve 52, a first seal 61, and a bearing 71 are formed. The first check valve 51 is disposed on a flow passage of the first suction passage 31 and the second check valve 52 is disposed on a flow passage of the first discharge passage 41 whereby a flow direction of a solvent liquid is restricted. The first plunger 21 (pressurization member) is held slidably inside the first plunger pump 101 by the bearing 71. The first seal 61 prevents liquid leakage from the first pressurization chamber 11.

The second plunger pump 102 includes a second pump head 112 in which a second pressurization chamber 12, a second plunger 22, a second suction passage 32, a second discharge passage 42, a second seal 62, and a bearing 72 are formed. The second check valve 52 and the second suction passage 32 are coupled together by means of the coupling flow passage 103. That is, the first plunger pump 101 and the second plunger pump 102 are disposed in series and the first plunger pump 101 is installed on the upstream side. The second plunger 22 (pressurization member) is held slidably inside the second plunger pump 102 by the bearing 72. The second seal 62 prevents liquid leakage from the second pressurization chamber 12.

In the present specification, a "lower limit point" indicates a position at which the plunger descends most in a range in which the plunger can move inside the pressurization chamber. Meanwhile, an "upper limit point" indicates a position at which the plunger ascends most in the range in which the plunger can move inside the pressurization chamber. "Ascending" of the plunger indicates a motion in a direction in which a solvent inside the pressurization chamber is compressed or discharged (a motion in the rightward direction in FIG. 1A). "Descending" of the plunger indicates a motion in a direction in which a solvent is sucked into the pressurization chamber (a motion in the leftward direction in FIG. 1A).

A reciprocating movement of the first plunger 21 is controlled by a first electric motor 211, a deceleration device 221, and a linear motion device 231. More specifically, the motor driver 210 supplies driving power to the first electric motor 211 to rotate it based on a command value from the controller 10. The rotation of the first electric motor 211 is decelerated by the deceleration device 221 and is converted into a linear motion by the linear motion device 231, so that the first plunger 21 reciprocates.

Similarly, a reciprocating movement of the second plunger 22 is controlled by a second electric motor 212, a deceleration device 222, and a linear motion device 232. More specifically, the motor driver 210 supplies driving power to the second electric motor 212 to rotate it based on a command value from the controller 10. The rotation of the second electric motor 212 is decelerated by the deceleration device 222 and is converted into a linear motion by the linear motion device 232, so that the second plunger 22 reciprocates.

The deceleration device 221 and the linear motion device 231 are combined to amplify a rotational power of the first electric motor 211 to convert it into a linear motion power, and are thus can be referred to as a power transmission mechanism device in a broad sense. The same applies to the deceleration device 222 and the linear motion device 232.

Specific examples of the deceleration devices 221 and 222 include a spur gear, a pulley, a planetary gear, and a worm gear. A main reason for providing the deceleration devices 221 and 222 is to increase torque of the first electric motor 211 and the second electric motor 212. When the first electric motor 211 and the second electric motor 212 have a capability to generate sufficient torque, installation of the deceleration devices 221 and 222 is not necessarily required. Specific examples of the linear motion devices 231 and 232 include a ball screw, a cam, and a rack and pinion.

The purge valve driver 310 supplies driving power to the purge valve 311 based on a command value from the controller 10. The purge valve 311 is connected downstream of the second plunger pump 102. The purge valve 311 switches a flow direction of the solvent discharged from the liquid feeding pump 1 to either the injector 2 side or the waste liquid tank 312 side.

The electromagnetic valve driver 410 supplies driving power to the first electromagnetic valve 81 and the second electromagnetic valve 82 based on command values from the controller 10. A solvent container that contains a first solvent 511 and a solvent container that contains a second solvent 512 are installed outside the liquid feeding pump 1. The first solvent 511 or the second solvent 512 is fed to the liquid feeding pump 1 by opening and closing the first electromagnetic valve 81 and the second electromagnetic valve 82 and driving the first plunger pump 101 and the second plunger pump 102 (first plunger 21 and second plunger 22).

When the first plunger pump 101 sucks a solvent, one of the first electromagnetic valve 81 and the second electromagnetic valve 82 turns into an open state and the other turns into a closed state, and one of the first solvent 511 and the second solvent 512 is sucked. The sucked solvent passes through a merge section 90, the first check valve 51, and the first suction passage 31 to be sucked into the first pressurization chamber 11. The solvent sucked into the first pressurization chamber 11 is compressed in accordance with ascending of the first plunger 21.

The solvent is compressed so that an internal pressure of the first pressurization chamber 11 becomes greater than an internal pressure of the second pressurization chamber 12. The solvent passes through the first discharge passage 41, the second check valve 52, the coupling flow passage 103, and the second suction passage 32 and enters the second pressurization chamber 12 to be discharged from the second discharge passage 42.

The injector 2 injects a sample as an analysis target into the solvent discharged from the liquid feeding pump 1. The solvent into which the sample was injected is introduced into the separation column 3 and is separated by components. Thereafter, the detector 4 detects absorbance, fluorescence intensity, a refractive index, or the like in accordance with the components of the sample. The separation column 3 is filled with fine particles. A fluid resistance when the solvent flows through gaps among the fine particles causes a load pressure from several tens of megapascals to a hundred or more megapascals in the liquid feeding pump 1. The magnitude of the load pressure varies depending on the diameter of the separation column 3 and the flow rate of passing.

<Hardware Configuration of Controller 10>

Figure 1B:
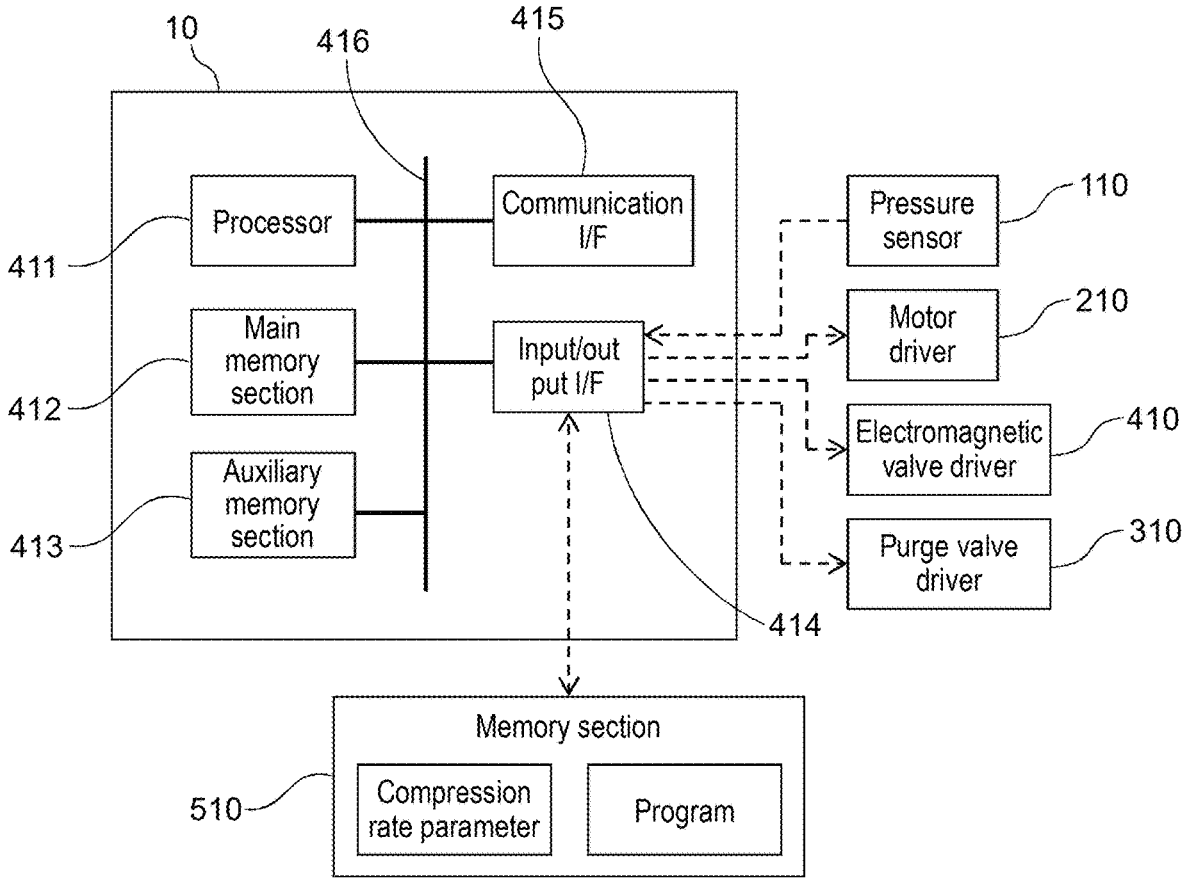
FIG. 1B is a hardware block diagram of a controller of Example 1.

FIG. 1B is a hardware block diagram of a controller of Example 1. The configuration of the controller 10 of Example 1 will be described with reference to FIG. 1B. The controller 10 reads and executes programs stored in the memory section 510, thereby executing each pieces of processing in a flowchart described later. The controller 10 includes a processor 411, a main memory section 412, an auxiliary memory section 413, an input/output interface (hereinafter, interface is abbreviated as I/F) 414, a communication I/F 415, and a bus 416 that communicatively connects the aforementioned modules.

The processor 411 is a central processing unit. The processor 411 is, for example, a CPU (Central Processing Unit), a DSP (Digital Signal Processor), and an ASIC (Application Specific Integrated Circuit). The processor 411 deploys programs stored in the memory section 510 in an executable manner in a work region of the main memory section 412 and executes the programs. The main memory section 412 transitorily stores programs to be executed by the processor 411, data (for example, compression rate parameter) to be processed by the processor, and the like. The main memory section 412 is a flush memory, a RAM (Random Access Memory), or the like. The auxiliary memory section 413, for example, stores a boot program for the controller 10 and the like and is a ROM (Read Only Memory) or the like. The memory section 510 is, for example, an HDD (Hard Disk Drive) or an SSD (Solid State Drive).

The input/output I/F 414 is communicatively connected to the pressure sensor 110, the motor driver 210, the electromagnetic valve driver 410, and the purge valve driver 310. The communication I/F 415 is communicatively connected to external equipment via a network.

The controller 10 may be a built-in controller that is built in the liquid feeding pump 1 or a controller on a cloud.

<Liquid Feeding Method>

The outline of a liquid feeding method when normal liquid feeding of a solvent is performed using the liquid feeding pump 1 of Example 1 will be described. Here, "normal liquid feeding" is a liquid feeding method when a solvent discharged from the liquid feeding pump 1 is made to flow to the injector 2, the separation column 3, and the detector 4 and a sample is analyzed. Note that for a case in which a sample is not analyzed (a solvent is fed to the waste liquid tank 312), the same operation is performed, and thus, the description will be omitted.

Figure 2:
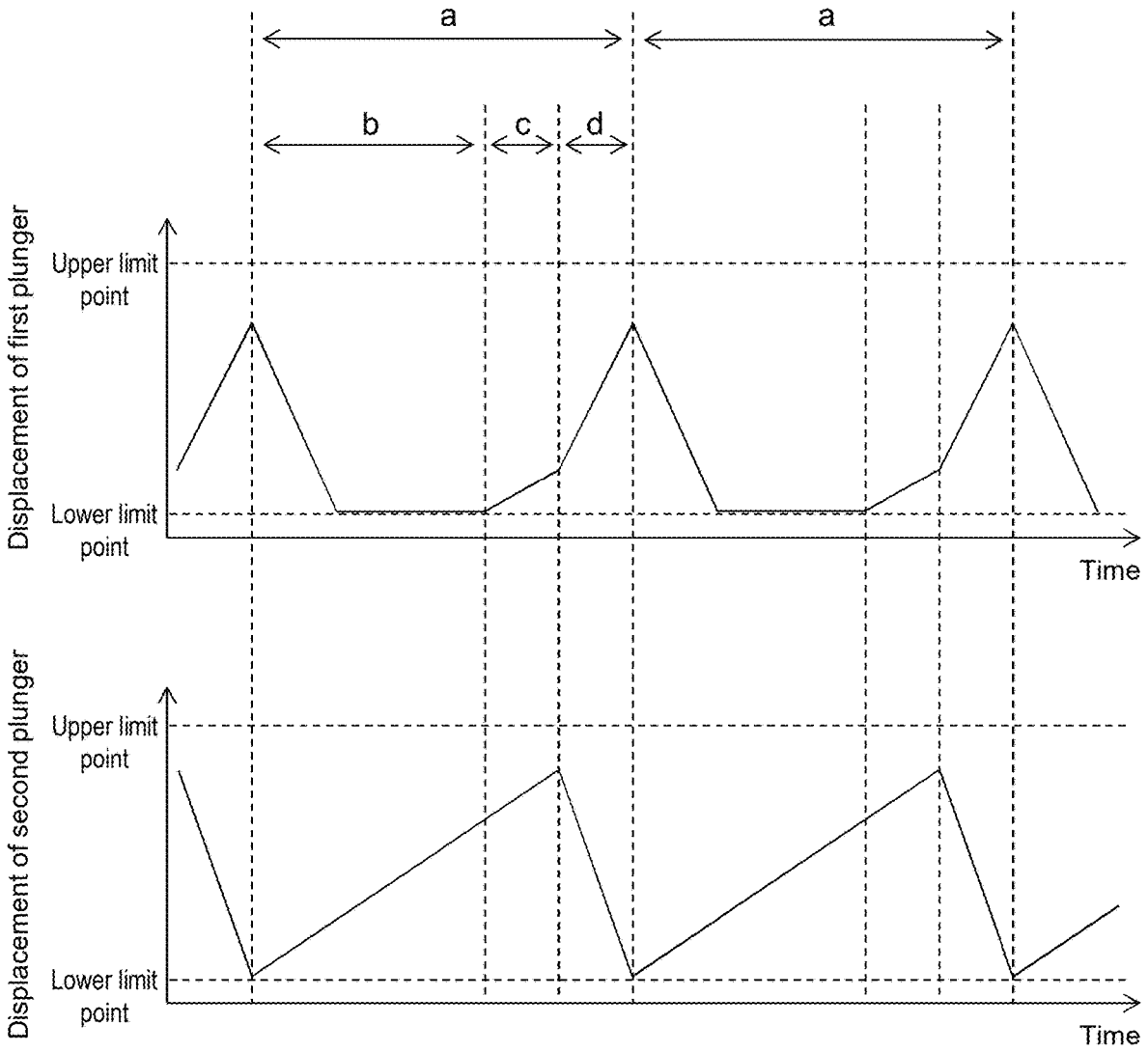
FIG. 2 show graphs illustrating displacement of plungers in performing normal liquid feeding of a solvent by the liquid feeding pump.

FIG. 2 show graphs illustrating displacement of plungers in performing the normal liquid feeding of a solvent by the liquid feeding pump. In both two graphs illustrated in FIG. 2, the lateral axis represents time and the longitudinal axis represents displacement of the first plunger 21 and displacement of the second plunger 22 in this order from the top. In the displacement of the first plunger 21 and the displacement of the second plunger 22, an ascending direction (rightward direction in FIG. 1A) is a positive direction and a descending direction (leftward direction in FIG. 1A) is a negative direction. In the normal liquid feeding, the first plunger 21 and the second plunger 22 both operate based on the lower limit point as a reference.

In the normal liquid feeding, the first plunger pump 101 and the second plunger pump 102 both perform a periodic operation. FIG. 2 illustrates two cycles. A driving cycle a includes three sections b, c, and d and is repeated. The length of the driving cycle a is, for example, two, four, or six seconds. Each section will be described.

The section b is referred to as a single liquid feeding section. In this section, the second plunger pump 102 discharges a liquid in a feeding amount designated by a device user. The first plunger 21 moves to the lower limit point and then halts until the section b ends. The first plunger 21 is displaced in the negative direction, but since the second check valve 52 closes the flow passage, the motion of the first plunger 21 does not affect the discharge flow rate.

The section c is referred to as a compression section. In this section, the second plunger pump 102 discharges the liquid in the feeding amount designated by the device user. The controller 10 retrieves a compression rate parameter stored in the memory section 510 and calculates, based on the compression rate parameter in conjunction with a pressure value received from the pressure sensor 110, an amount of compression (displacement amount of the plunger) of a solvent by the first plunger 21 necessary for compression of the first plunger pump 101. Thereafter, the first plunger 21 moves in the positive direction by the calculated amount of compression under the control of the controller 10. Since the second check valve 52 is closed until the pressure in the first pressurization chamber 11 of the first plunger pump 101 exceeds the discharge pressure, the motion of the first plunger 21 does not affect the discharge flow rate. When excessive compression occurs, the second check valve 52 is opened whereby the discharge flow rate and the discharge pressure start increasing.

Though the details of a feedback control method will be described later, in a case where when the first plunger 21 moves by the calculated amount of compression, excessive compression occurs whereby the pressure value of the pressure sensor 110 increases, the controller 10 reduces the compression rate parameter stored in the memory section 510, as necessary.

The section d is referred to as a cross liquid feeding section. In this section, the second plunger 22 moves to the lower limit point. The first plunger 21 moves in the positive direction and the first plunger pump 101 discharges the liquid at a flow rate value, which is a total of the flow rate to be sucked by the second plunger pump 102 resulted from the second plunger 22 moving in the negative direction and the flow rate designated by the device user, so that the liquid feeding pump, as a whole, discharges the liquid in the feeding amount designated by the device user. Though the details of the feedback control method will be described later, in a case where in shifting from the compression section c to the cross liquid feeding section d, the pressure value received from the pressure sensor 110 is reduced due to insufficient compression of the first pressurization chamber 11, the controller 10 increases the compression rate parameter stored in the memory section 510, as necessary.

After the cross liquid feeding section d ends, the operation is shifted to the single liquid feeding section b, and the same periodic operation is repeated.

<Feedback Control>

A feedback control of the compression rate parameter of Example 1 will be described. As described in <liquid feeding method> above, the liquid feeding pump 1 repeats the driving cycle a including the single liquid feeding section b, the compression section c, and the cross liquid feeding section d. For correct calculation of the amount of compression in the compression section c, the feedback control of the compression rate parameter is required. The feedback control is performed for two occasions of excessive compression and insufficient compression. In the compression section c, excessive compression occurs and in shifting to the cross liquid feeding section d, insufficient compression occurs. When excessive compression occurs, the compression rate parameter is reduced. When insufficient compression occurs, the compression rate parameter is increased. In the case of excessive compression, a momentary pressure increase occurs. In the case of insufficient compression, a momentary pressure reduction occurs. When the amount of each change (increase amount, reduction amount) exceeds a pressure fluctuation threshold, such a change is determined to be caused by disturbance. When such determination is the first time within a disturbance determination period, the compression rate parameter is not corrected. However, when such determination is made twice or more within the disturbance determination period, the compression rate parameter is corrected for the second time and beyond.

For the pressure fluctuation threshold, for example, a change of 0.5 megapascals or greater for 10 seconds and a change of 1 megapascal or greater for 20 seconds are set. For the pressure fluctuation threshold, it is preferable that the magnitude of disturbance occurring due to operations of the injector 2 and a switching valve is measured in advance and the pressure fluctuation by disturbance empirically presumed is set in accordance with use conditions by a device user.

The disturbance determination period is preferably set to be several to several ten times longer than a period of the driving cycle. For example, a predetermined period of time, for example, 30 seconds or 1 minute, is set. For a correction amount of the compression rate parameter, it is common to linearly change the compression rate parameter based on the value of the pressure increase occurring due to excessive compression, the value of the pressure reduction occurring due to insufficient compression, and a preset correction coefficient.

<Flowchart of Feedback Control>

Figure 3:
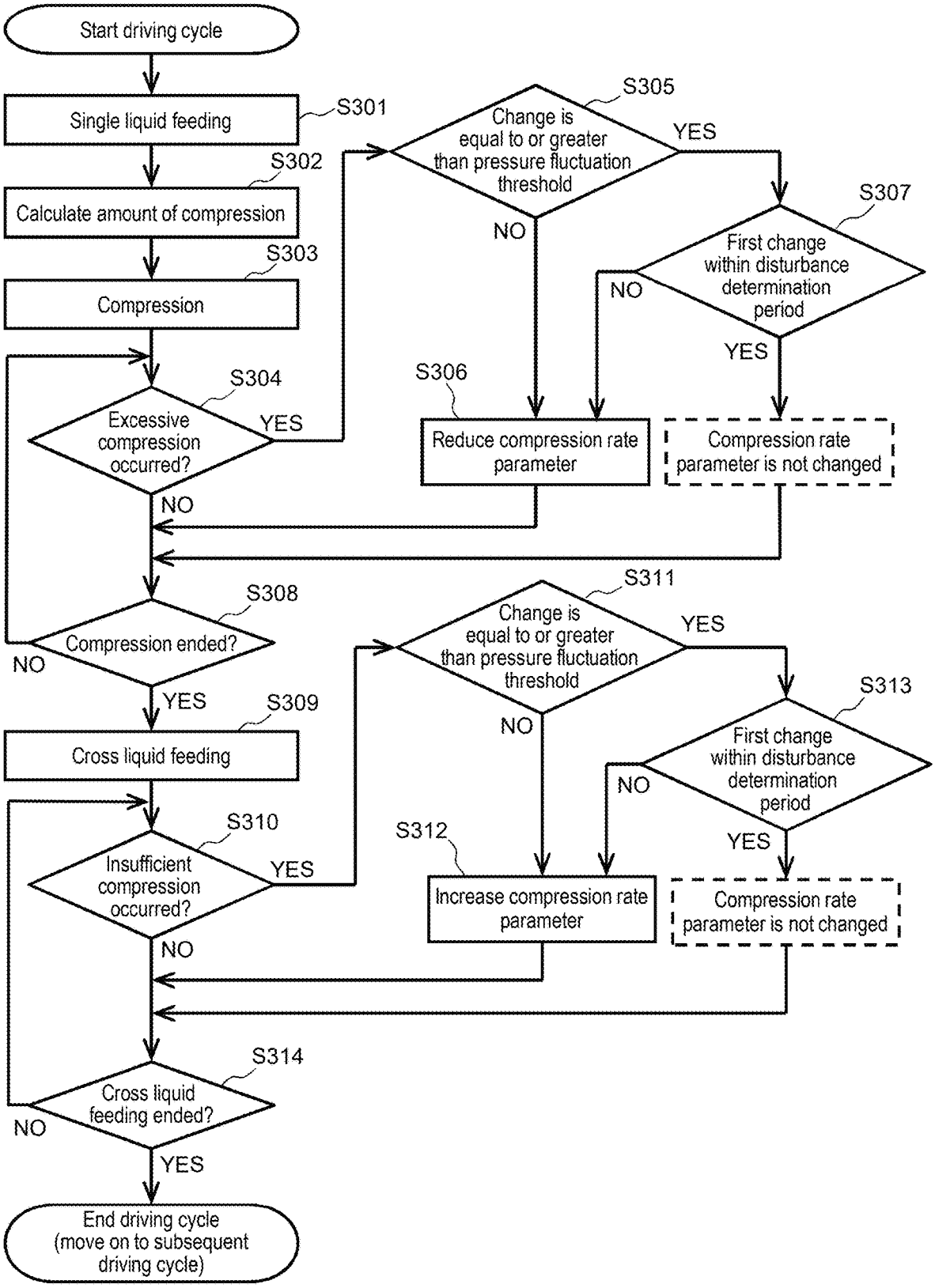
FIG. 3 is a flowchart illustrating the operation of the liquid feeding pump, including a feedback control of a compression rate parameter of Example 1.

FIG. 3 is a flowchart illustrating the operation of the liquid feeding pump, including the feedback control of the compression rate parameter of Example 1. Steps of the flowchart are executed by the controller 10 that executes programs stored in the memory section 510.

(Step S301)

In the single liquid feeding section b, the controller 10 controls the operation of the second electric motor 212 and the like to move the second plunger 22 from the lower limit point in the positive direction to cause a liquid in a feeding amount designated by a device user to be discharged. Further, the controller 10 controls the operation of the first electric motor 211 and the like to move the first plunger 21 to the lower limit point and then to halt until the section b ends.

(Step S302)

The controller 10 retrieves the compression rate parameter stored in the memory section 510 and calculates, based on the compression rate parameter in conjunction with a pressure value received from the pressure sensor 110, an amount of compression (displacement amount of the plunger) by the first plunger 21 necessary for compression of the first plunger pump 101.

(Step S303)

In the compression section c, the controller 10 controls the operation of the second electric motor 212 and the like to further move the second plunger 22 in the positive direction to cause the liquid in the feeding amount designated by the device user to be discharged. Further, the controller 10 controls the operation of the first electric motor 211 and the like to move the first plunger 21 in the positive direction by the calculated amount of compression.

(Step S304)

The controller 10 determines, based on the pressure value received from the pressure sensor 110, whether excessive compression has occurred. For example, the controller 10 may determine that excessive compression has occurred when the pressure value received from the pressure sensor 110 has become greater than a threshold or may determine that excessive compression has occurred when a change amount (increase amount) of the pressure value received from the pressure sensor 110 has become greater than a threshold.

(Step S305)

When occurrence of excessive compression is determined (Step S304: Yes), the controller 10 determines whether the pressure change amount in the excessive compression is a change equal to or greater than a pressure fluctuation threshold.

(Step S306)

When the pressure change amount in the excessive compression is not determined to be a change equal to or greater than the pressure fluctuation threshold (Step S305: No), the controller 10 reduces the compression rate parameter so as to reduce the amount of compression of a solvent by the first plunger 21.

(Step S307)

When the pressure change amount in the excessive compression is determined to be a change equal to or greater than the pressure fluctuation threshold (Step S305: Yes), the controller 10 determines whether the pressure change in the excessive compression is a change for the first time (the first change) within the disturbance determination period. If the pressure change occurs a plurality of times within the disturbance determination period, the pressure change is determined to be caused by an internal factor of the liquid feeding pump 1. If the pressure change occurs only once within the disturbance determination period, the pressure change is determined to be caused by an external factor of the liquid feeding pump 1. When the pressure change in the excessive compression is not determined to be the first change (the second change and beyond) within the disturbance determination period (Step S307: No), the controller 10 executes processing of reducing the compression rate parameter in step S306 described above. Meanwhile, when the pressure change in the excessive compression is determined to be the first change within the disturbance determination period (Step S307: Yes), the controller 10 does not change the compression rate parameter.

(Step S308)

The controller 10 determines whether the compression by the first plunger 21 has ended. Until the compression by the first plunger 21 ends (Step S308: No), the controller 10 repeats the processing of determining whether excessive compression has occurred (Step S304).

(Step S309)

When the compression by the first plunger 21 ends (Step S308: Yes), in the cross liquid feeding section d, the controller 10 controls the operation of the second electric motor 212 and the like to move the second plunger 22 to the lower limit point in the negative direction. Further, the controller 10 controls the operation of the first electric motor 211 and the like to move the first plunger 21 in the positive direction to cause the flow rate, which is the total of the flow rate to be sucked by the second plunger pump 102 and the flow rate designated by the device user, to be discharged.

(Step S310)

The controller 10 determines, based on the pressure value received from the pressure sensor 110, whether insufficient compression has occurred. For example, the controller 10 may determine that insufficient compression has occurred when the pressure value received from the pressure sensor 110 has become smaller than a threshold. The controller 10 may determine that insufficient compression has occurred when a change amount (reduction amount) of the pressure value received from the pressure sensor 110 has become greater than a threshold.

(Step S311)

When occurrence of insufficient compression is determined (Step S310: Yes), the controller 10 determines whether the pressure change amount in the insufficient compression is a change equal to or greater than a pressure fluctuation threshold. Note that the pressure fluctuation threshold used in step S311 and the pressure fluctuation threshold used in step S305 described above may be shared in common or may be discrete values.

(Step S312)

When the pressure change amount in the insufficient compression is not determined to be a change equal to or greater than the pressure fluctuation threshold (Step S311:

No), the controller 10 increases the compression rate parameter so as to increase the amount of compression of the solvent by the first plunger 21.

(Step S313)

When the pressure change amount in the insufficient compression is determined to be a change equal to or greater than the pressure fluctuation threshold (Step S311: Yes), the controller 10 determines whether the pressure change in the insufficient compression is a change for the first time (the first change) within the disturbance determination period. If the pressure change occurs a plurality of times within the disturbance determination period, the pressure change is determined to be caused by an internal factor of the liquid feeding pump 1. If the pressure change occurs only once within the disturbance determination period, the pressure change is determined to be caused by an external factor of the liquid feeding pump 1. When the pressure change in the insufficient compression is not determined to be the first change (the second change and beyond) within the disturbance determination period (Step S313: No), the controller 10 executes processing of increasing the compression rate parameter in step S312 described above. Meanwhile, when the pressure change in the insufficient compression is determined to be the first change within the disturbance determination period (Step S313: Yes), the controller 10 does not change the compression rate parameter.

(Step S314)

The controller 10 determines whether the cross liquid feeding has ended. Until the cross liquid feeding ends (Step S314: No), the controller 10 repeats the processing of determining whether insufficient compression has occurred (Step S310).

<Effects of Feedback Control (When Insufficient Compression First Occurs Within Disturbance Determination Period)>

Figure 4:
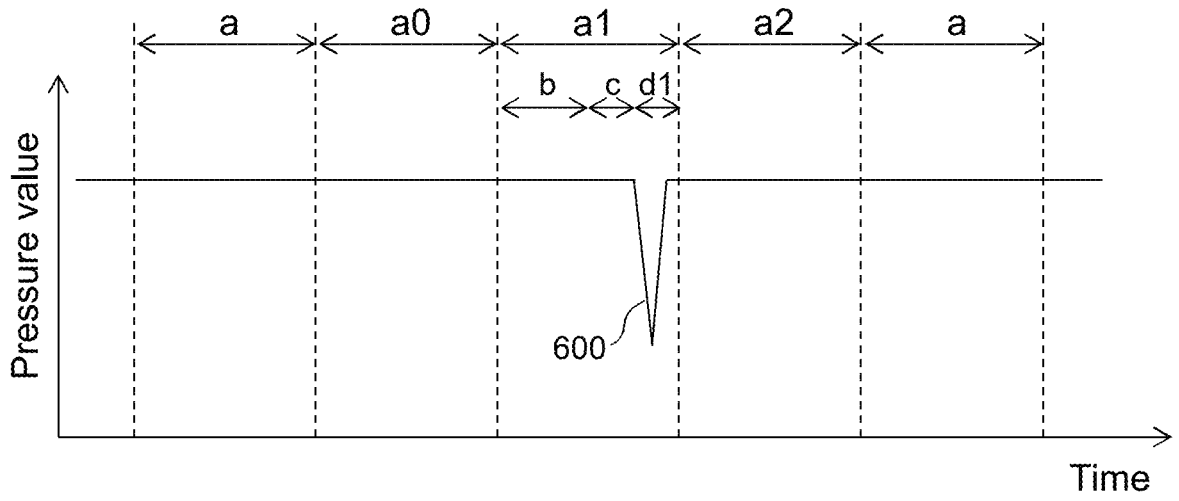
FIG. 4 is a graph illustrating a pressure value measured by a pressure sensor of Example 1.

Next, the effects of the feedback control of the compression rate parameter will be described for a case of insufficient compression first occurring within the disturbance determination period. FIG. 4 is a graph illustrating a pressure value measured by the pressure sensor of Example 1. The lateral axis represents time and the longitudinal axis represents a pressure value measured by the pressure sensor 110. As described above, the liquid feeding pump 1 repeats the driving cycle a including the single liquid feeding section b, the compression section c, and the cross liquid feeding section d. When correct operation is repeated, the pressure value measured by the pressure sensor 110 is constant. Here, it is assumed that at the start of a cross liquid feeding section d1 in a driving cycle a1, an injection valve in the injector 2 is switched and a sample with an atmospheric pressure is injected into the flow passage. In that case, a significant pressure reduction occurs as an injection shock 600.

According to a typical feedback control of the liquid feeding pump, when a pressure reduction occurs at the start of the cross liquid feeding section d, insufficient compression is determined whereby the compression rate parameter is corrected. However, the injection shock 600 is caused by switching a valve present outside the liquid feeding pump 1 and is not the pressure reduction due to insufficient compression. Therefore, ideally, the injection shock 600 is preferably excluded from the target of the feedback control.

Thus, in Example 1, as illustrated in step S311 of FIG. 3, after the insufficient compression is determined (Step S310: Yes), it is determined whether the pressure change amount in the insufficient compression is a change equal to or greater than the pressure fluctuation threshold. The injection shock 600 is apparently a significant pressure reduction and the change amount is equal to or greater than the pressure fluctuation threshold. Therefore, in the feedback control illustrated in FIG. 3, the compression rate parameter is not corrected in accordance with Yes determination in step S313. Accordingly, in a driving cycle a2 in FIG. 4, the amount of compression is calculated based on the compression rate parameter used in the driving cycle a1. In this manner, correct pump control is still performed in the driving cycle a2 and beyond without necessarily following the injection shock 600.

Note that in the example in FIG. 4, a case of only the injection shock 600 occurring has been described, but when excessive compression or insufficient compression occurs in addition to the injection shock 600, the compression rate parameter could be corrected. For example, even when the compression rate parameter is not corrected as described above (Step S313: Yes), if excessive compression occurs (Step S304: Yes) before determination of insufficient compression and the compression rate parameter is corrected in step S306, the amount of compression in the driving cycle a2 is calculated using the corrected compression rate parameter. In other words, calculating the amount of compression based on the compression rate parameter used in the driving cycle a1 includes calculating the amount of compression using the same parameter as the compression rate parameter used in the driving cycle a1 and calculating the compression rate using the compression rate parameter obtained by correcting the compression rate parameter used in the driving cycle a1 due to a factor other than disturbance determination.

<Effects of Feedback Control (When Insufficient Compression Occurs Twice or More Within Disturbance Determination Period)>

Figure 5:
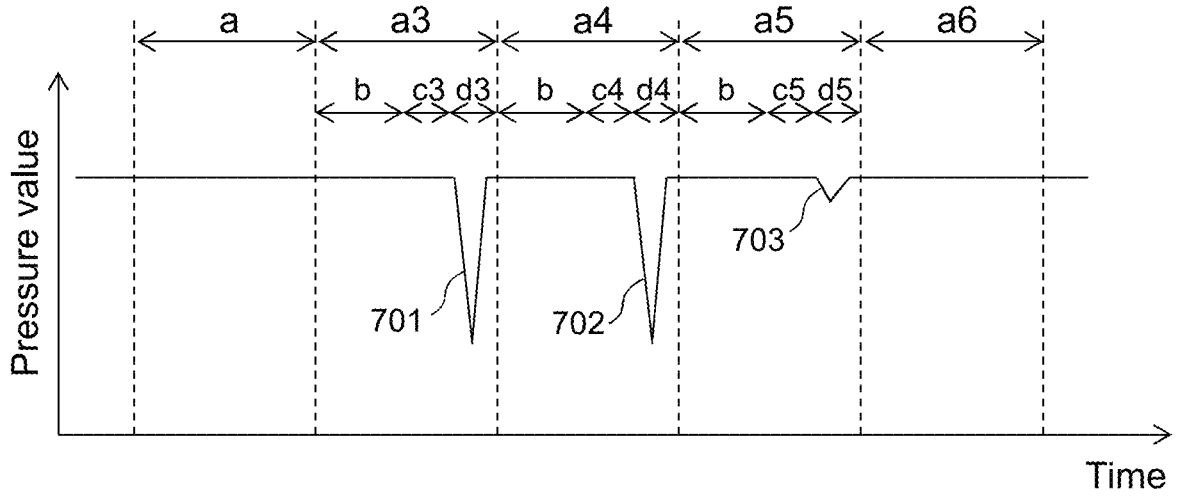
FIG. 5 is a graph illustrating a pressure value measured by the pressure sensor of Example 1.

The effects of the feedback control of the compression rate parameter will be described for a case of insufficient compression occurring twice or more within the disturbance determination period. FIG. 5 is a graph illustrating a pressure value measured by the pressure sensor of Example 1, as with FIG. 4. As described above, the liquid feeding pump 1 repeats the driving cycle a including the single liquid feeding section b, the compression section c, and the cross liquid feeding section d. When correct operation is repeated, the pressure value measured by the pressure sensor 110 is constant.

Here, it is assumed that in a driving cycle a3, the device user changed a set value for the liquid feeding pump 1 by mistake. For example, it is assumed that despite pure water being set in the liquid feeding pump 1, solvent setting was changed to methanol by mistake. Since the compression rate of methanol is smaller than that of water, the compression rate parameter in the device is transitorily changed to a smaller value. In a compression section c3 in the driving cycle a3, the amount of compression is calculated based on the compression rate parameter of methanol and the compression is executed. However, since the solvent actually connected to the liquid feeding pump is pure water, insufficient compression occurs, which, as a result, causes a significant pressure reduction 701 at the start of a cross liquid feeding section d3.

As described in FIG. 3, the significant pressure reduction 701 is a change equal to or greater than the pressure fluctuation threshold and is thus excluded from the target of the feedback control, and the compression rate parameter is not changed. Therefore, in a subsequent driving cycle a4, control is performed using the same compression rate parameter as that in the driving cycle a3. As a result, in a compression section c4, the same compression process as that in the compression section c3 is performed, and at the start of a cross liquid feeding section d4, a significant pressure reduction 702 similar to the significant pressure reduction 701 occurs.

Here, the significant pressure reduction 702 occurs after a driving cycle time, e.g., four seconds elapses from the significant pressure reduction 701. The second significant pressure reduction 702 is detected before the disturbance determination time (for example, 30 seconds) elapses, and is thus not determined to be the first change within the disturbance determination period in accordance with the flowchart in FIG. 3 (Step S313: No). Therefore, the significant pressure reduction 702 is the target of the feedback control and the compression rate parameter is increased based on the pressure reduction amount. Thus, in a subsequent driving cycle a5, control is performed using the compression rate parameter greater than that in the driving cycle a4.

In the correction of the compression rate parameter, the compression rate parameter cannot be changed to the optimum value at a time in some cases. In the driving cycle a5, insufficient compression still remains and a small compression reduction 703 occurs. Thus, in Example 1, step S311 (No) and step S312 in FIG. 3 are executed to increase the compression rate parameter based on the small compression reduction 703. In this manner, in a driving cycle a6 and beyond, it is expected that the liquid feeding pump 1 is further correctly controlled.

In this manner, according to Example 1, disturbance such as the injection shock 600 can be excluded from the target of the feedback control.

Further, when the liquid feeding pump 1 has made a significant compression error as an internal factor, the error becomes the target of the feedback control in the second cycle and beyond. Thus, there is an advantage in that the compression rate parameter is corrected. This utilizes the matters that disturbance such as the injection shock 600 less frequently occurs, and excessive compression and insufficient compression occur at an interval of the driving cycle (interval of approximately several seconds).

Further, in Example 1, occurrence of disturbance such as the injection shock 600 can be determined based on the pressure value measured by the pressure sensor 110. In other words, in Example 1, occurrence of disturbance can be determined based on the pressure value measured by the pressure sensor 110, without receiving a control signal of a valve from an external device, unlike Patent Literature 4.

Example 2

In Example 1, when the change amount of the pressure value is a fluctuation equal to or greater than the pressure fluctuation threshold, the compression rate parameter is not changed. In Example 2, when the fluctuation amount of the compression rate parameter changed in accordance with the change amount of the pressure fluctuation value is a fluctuation equal to or greater than a compression rate parameter changeable threshold, the compression rate parameter is not changed.

For example, when the compression rate parameter changeable threshold is ±30%, in a case where the compression rate parameter fluctuates by 30% or more in the feedback control performed once, the fluctuation is determined to be caused by disturbance and the compression rate parameter is not changed. The compression rate parameter changeable threshold is preferably set in accordance with use conditions of a device user, preferably, for example, at 30%, 50%, and 70%. The compression rate parameter changeable threshold may be set using an absolute value, without being limited to a ratio.

Figure 6:
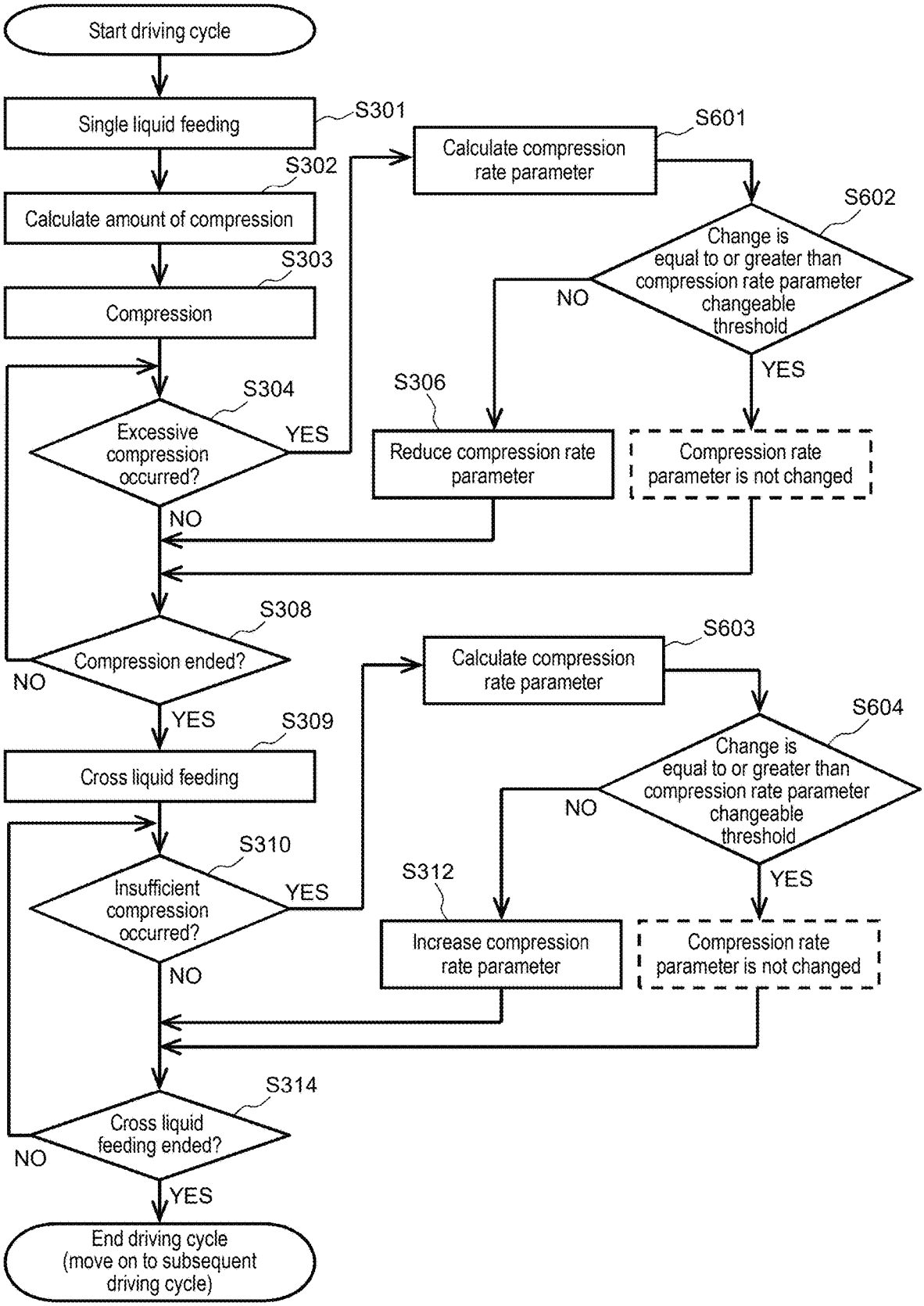
FIG. 6 is a flowchart illustrating the operation of the liquid feeding pump, including the feedback control of the compression rate parameter of Example 2.

FIG. 6 is a flowchart illustrating the operation of the liquid feeding pump, including the feedback control of the compression rate parameter of Example 2. The descriptions overlapping those of Example 1 will be omitted, as appropriate.

(Step S601)

When occurrence of excessive compression is determined (Step S304: Yes), the controller 10 calculates the compression rate parameter based on the pressure value detected by the pressure sensor 110. Then, the controller 10 calculates the difference between the calculated compression rate parameter and the compression rate parameter before calculation. Note that the controller 10 may calculate the compression rate parameter based on the change amount of the pressure value detected by the pressure sensor 110.

(Step S602)

The controller 10 determines whether the difference in the compression rate parameter is a change equal to or greater than the compression rate parameter changeable threshold.

(Step S306)

When the difference in the compression rate parameter is not determined to be a change equal to or greater than the compression rate parameter changeable threshold (Step S602: No), the controller 10 reduces the compression rate parameter so as to reduce the amount of compression of the solvent by the first plunger 21. Meanwhile, when the difference in the compression rate parameter is determined to be a change equal to or greater than the compression rate parameter changeable threshold (Step S602: Yes), the controller 10 does not change the compression rate parameter.

(Step S603)

When occurrence of insufficient compression is determined (Step S310: Yes), the controller 10 calculates the compression rate parameter based on the pressure value detected by the pressure sensor 110. Then, the controller 10 calculates the difference between the calculated compression rate parameter and the compression rate parameter before calculation. Note that the controller 10 may calculate the compression rate parameter based on the change amount of the pressure value detected by the pressure sensor 110.

(Step S604)

The controller 10 determines whether the difference in the compression rate parameter is a change equal to or greater than the compression rate parameter changeable threshold.

(Step S312)

When the difference in the compression rate parameter is not determined to be a change equal to or greater than the compression rate parameter changeable threshold (Step S604: No), the controller 10 increases the compression rate parameter so as to increase the amount of compression by the first plunger 21. Meanwhile, when the difference in the compression rate parameter is determined to be a change equal to or greater than the compression rate parameter changeable threshold (Step S604: Yes), the controller 10 does not change the compression rate parameter.

Note that also in Example 2, the determination as in step S307 and 313 in FIG. 3 is made, and when the difference in the compression rate parameter within the disturbance determination period being a change equal to or greater than the threshold is the first time, the compression rate parameter may not be changed, and the compression rate parameter may be changed for the second time and beyond.

In Example 2, as with Example 1, the feedback control of the compression rate parameter can be appropriately performed by determining disturbance without acquiring a control signal from an external device.

Example 3

Figure 7:
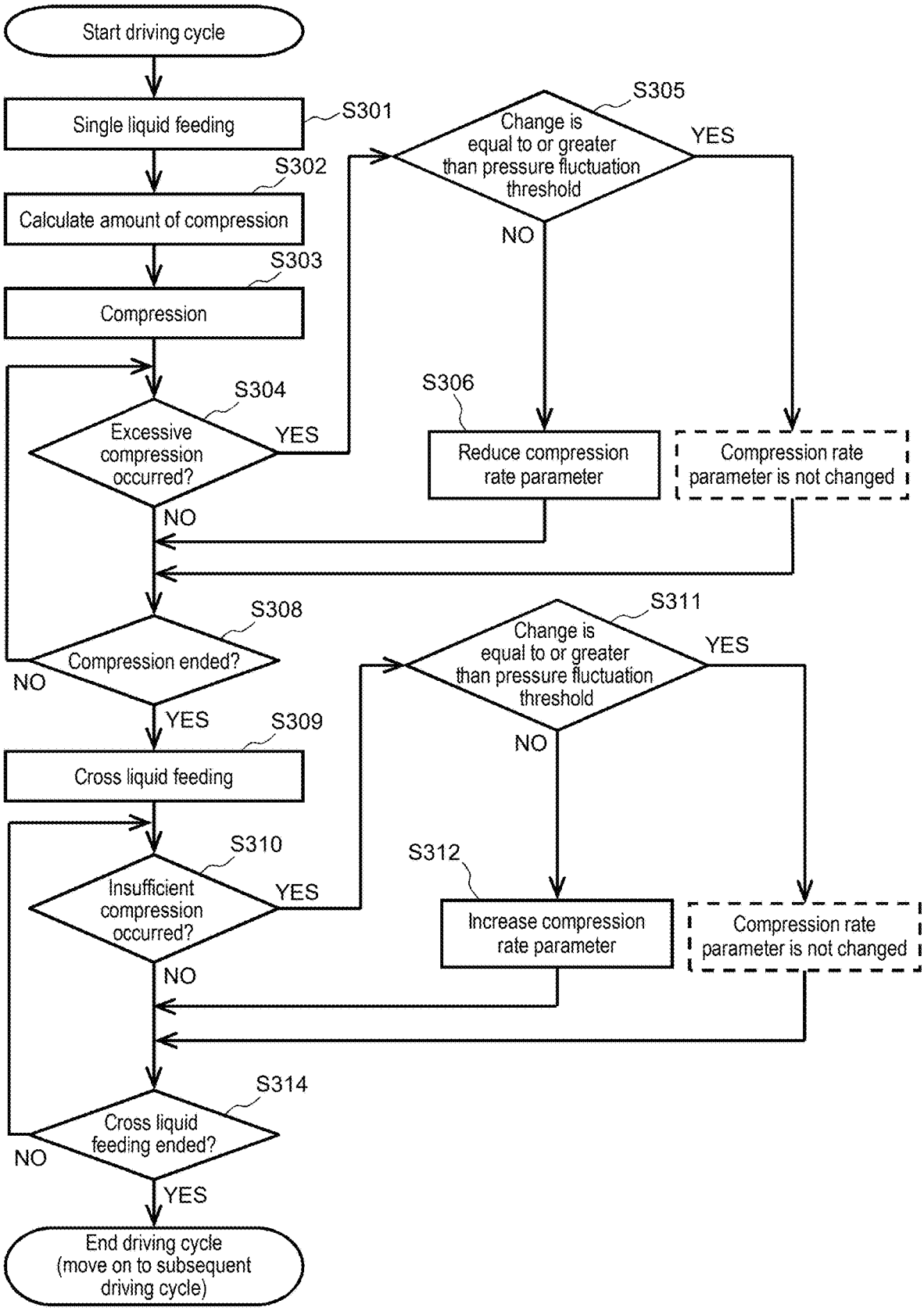
FIG. 7 is a flowchart illustrating the operation of the liquid feeding pump, including the feedback control of the compression rate parameter of Example 3.

In Example 1, as in step S307 and S313 in FIG. 3, it is determined whether the pressure fluctuation equal to or greater than the threshold within the disturbance determination period is the first time. In Example 3, such determination is omitted. FIG. 7 is a flowchart illustrating the operation of the liquid feeding pump, including the feedback control of the compression rate parameter of Example 3. The descriptions overlapping those of Example 1 will be omitted, as appropriate.

(Step S305)

When occurrence of excessive compression is determined (Step S304: Yes), the controller 10 determines whether the pressure change amount in the excessive compression is a change equal to or greater than the pressure fluctuation threshold.

(Step S306)

When the pressure change amount in the excessive compression is not determined to be a change equal to or greater than the pressure fluctuation threshold (Step S305: No), the controller 10 reduces the compression rate parameter so as to reduce the amount of compression by the first plunger 21. Meanwhile, when the pressure change amount in the excessive compression is determined to be a change equal to or greater than the pressure fluctuation threshold (Step S305: Yes), the controller 10 does not change the compression rate parameter.

(Step S311)

When occurrence of insufficient compression is determined (Step S310: Yes), the controller 10 determines whether the pressure change amount in the insufficient compression is a change equal to or greater than the pressure fluctuation threshold.

(Step S312)

When the pressure change amount in the insufficient compression is not determined to be a change equal to or greater than the pressure fluctuation threshold (Step S311: No), the controller 10 increases the compression rate parameter so as to increase the amount of compression by the first plunger 21. Meanwhile, when the pressure change amount in the insufficient compression is determined to be a change equal to or greater than the pressure fluctuation threshold (Step S311: Yes), the controller 10 does not change the compression rate parameter.

In Example 3, even when disturbance periodically occurs, it is possible to determine disturbance without acquiring a control signal from an external device and appropriately perform the feedback control of the compression rate parameter.

Modification

Note that the present invention is not limited to the aforementioned examples and includes various modifications. The aforementioned examples are described in detail for easier understanding of the present invention, and are not necessarily limited to those including all the described configurations. Further, it is possible to replace a part of the configuration of one example with the configuration of another example, and it is also possible to add the configuration of one example to the configuration of another example. Furthermore, for a part of the configuration of the examples, deletion, and addition of and replacing with other configurations are available.

In Examples 1 and 2, the examples have been described in which the feedback control of the compression rate parameter is performed when excessive compression occurs in the compression section c and when insufficient compression occurs in the cross liquid feeding section d. In other words, in Examples 1 and 2, the feedback control of the compression rate parameter is not performed when excessive compression and insufficient compression occur in the single liquid feeding section b, when insufficient compression occurs in the compression section c, and when excessive compression occurs in the cross liquid feeding section d. However, in the present disclosure,

- the feedback control of the compression rate parameter may be performed when excessive compression occurs in the single liquid feeding section b, by following steps S305 to S307 in FIG. 3,
- the feedback control of the compression rate parameter may be performed when insufficient compression occurs in the single liquid feeding section b, by following steps S311 to S313 in FIG. 3,
- the feedback control of the compression rate parameter may be performed when insufficient compression occurs in the compression section c, by following steps S311 to S313 in FIG. 3, and
- the feedback control of the compression rate parameter may be performed when excessive compression occurs in the cross liquid feeding section d, by following steps S305 to S307 in FIG. 3.

In Example 1, in step S305 and S311, the pressure change amount is compared with the pressure fluctuation threshold. Alternatively, the pressure value measured by the pressure sensor 110 may be compared with a pressure threshold. In other words, in the present disclosure, when the value (including the pressure change amount and the pressure value) relating to the pressure value measured by the pressure sensor 110 is smaller than a threshold, the compression rate parameter may be changed.

In Example 1, when the first (for the first time) pressure fluctuation occurs within the disturbance determination period, the compression rate parameter is not corrected, and when the pressure fluctuation occurs twice or more within the disturbance determination period, the compression rate parameter is corrected for the second time and beyond. However, the aforementioned number of times is not limited to once. For the pressure fluctuation occurring within a predetermined number of times N (N is an integer equal to or greater than 2) within the disturbance determination period, the compression rate parameter may not be corrected. When the pressure fluctuation occurs N+1 times or more within the disturbance determination period, the compression rate parameter may be corrected.

In Examples 1 to 3, the examples have been described in which the feedback control of the compression rate parameter is performed for both cases of occurrence of excessive compression and insufficient compression. However, in the present disclosure, the feedback control of the compression rate parameter may be performed only when excessive compression has occurred. Alternatively, the feedback control of the compression rate parameter may be performed only when insufficient compression has occurred.

In Examples 1 to 3, when the pressure fluctuation is large, the measurement value detected by the detector 4 may be notified by differentiating it from a measurement value at normal time.

REFERENCE SIGNS LIST

1 Liquid feeding pump
2 Injector
3 Separation column
4 Detector
5 Waste liquid container
10 Controller
11 First pressurization chamber
12 Second pressurization chamber
21 First plunger
22 Second plunger
31 First suction passage
32 Second suction passage
41 First discharge passage
42 Second discharge passage
51 First check valve
52 Second check valve
100 Liquid chromatograph
101 First plunger pump
102 Second plunger pump
103 Coupling flow passage
110 Pressure sensor
210 Motor driver
310 Purge valve driver
410 Electromagnetic valve driver
510 Memory section

The invention claimed is:

1. A liquid feeding pump comprising:

a first plunger pump including a first plunger;

a second plunger pump connected to the first plunger pump in series, the second plunger pump including a second plunger;

a pressure sensor disposed downstream of the second plunger pump;

a control section that controls driving of the first plunger and driving of the second plunger; and a memory section that stores a compression rate parameter for calculating an amount of compression of a solvent by the first plunger, wherein the control section is configured to:

calculate a first amount of compression of the solvent by the first plunger in one driving cycle based on the compression rate parameter and control the first plunger to compress the solvent by the first amount of compression in the one driving cycle;

when a change amount of the compression rate parameter changed in accordance with a pressure value measured by the pressure sensor is smaller than a threshold in the one driving cycle, change the compression rate parameter in accordance with the pressure value and calculate a second amount of compression of the solvent by the first plunger in a subsequent driving cycle, which is subsequent to the one driving cycle, based on the compression rate parameter after being changed by the controller in accordance with the pressure value; and when the change amount of the compression rate parameter is greater than the threshold, calculate a third amount of compression of the solvent by the first plunger in the subsequent driving cycle, based on the compression rate parameter.

2. The liquid feeding pump according to claim 1, wherein the control section is configured not to change the compression rate parameter when a number of times when the change amount of the compression rate parameter is greater than the threshold during a predetermined period of time is smaller than a predetermined number of times.

3. The liquid feeding pump according to claim 2, wherein the control section is configured to change the compression rate parameter when the number of times when the change amount of the compression rate parameter is greater than the threshold during the predetermined period of time is greater than the predetermined number of times.

4. The liquid feeding pump according to claim 3, wherein the predetermined period of time is longer than the one driving cycle.

5. The liquid feeding pump according to claim 2, wherein the predetermined period of time is longer than the one driving cycle.

6. The liquid feeding pump according to claim 1, wherein the one driving cycle comprises a compression section in which the first plunger compresses the solvent, and when an increase amount of the compression rate parameter changed in accordance with the pressure value measured by the pressure sensor in the compression section in the one driving cycle is smaller than the threshold, the control section is configured to change the compression rate parameter so that the amount of compression of the solvent by the first plunger in the subsequent driving cycle is reduced.

7. The liquid feeding pump according to claim 1, wherein the one driving cycle comprises a compression section in which the first plunger compresses the solvent and a liquid feeding section in which the solvent compressed in the compression section is fed to a downstream side, and when a reduction amount of the compression rate parameter changed in accordance with the pressure value measured by the pressure sensor in the liquid feeding section in the one driving cycle is smaller than the threshold, the control section is configured to change the compression rate parameter so that the amount of compression of the solvent by the first plunger in the subsequent driving cycle is increased.

8. A liquid feeding method for a solvent in a liquid feeding pump, the liquid feeding pump comprising:

a first plunger pump including a first plunger;

a second plunger pump connected to the first plunger pump in series, the second plunger pump including a second plunger; and a pressure sensor disposed downstream of the second plunger pump, wherein the liquid feeding method comprises:

calculating a first amount of compression of the solvent by the first plunger in one driving cycle based on a compression rate parameter for calculating an amount of compression of the solvent by the first plunger and controlling the first plunger to compress the solvent by the first amount of compression in the one driving cycle;

when a change amount of the compression rate parameter changed in accordance with a pressure value measured by the pressure sensor is smaller than a threshold in the one driving cycle, changing the compression rate parameter in accordance with the pressure value, and calculating a second amount of compression of the solvent by the first plunger in a subsequent driving cycle, which is subsequent to the one driving cycle, based on the compression rate parameter after being changed by the controller in accordance with the pressure value; and when the change amount of the compression rate parameter is greater than the threshold, calculating a third amount of compression of the solvent by the first plunger in the subsequent driving cycle, based on the compression rate parameter.

* * * * *